United States Patent [19]

Mitani et al.

[11] Patent Number: 4,678,261

[45] Date of Patent: Jul. 7, 1987

[54] L-TYPE COAXIAL PLUG CONNECTOR

[75] Inventors: Ikujirou Mitani; Norihide Kawanami; Fumio Kobayashi, all of Tokyo, Japan

[73] Assignee: Hirose Electric Co., Ltd., Tokyo, Japan

[21] Appl. No.: 855,183

[22] Filed: Apr. 23, 1986

[51] Int. Cl.[4] ..... H01R 17/18

[52] U.S. Cl. ..... 439/582; 439/585; 439/471

[58] Field of Search ..... 339/177 R, 177 E, 276 R, 339/276 SF, 103 R, 103 B, 220, 221

[56] References Cited

U.S. PATENT DOCUMENTS

| | | | |
|---|---|---|---|
| 2,887,667 | 5/1959 | Wolfe et al. | 339/177 E |
| 4,010,538 | 3/1977 | O'Keefe et al. | 339/177 E |
| 4,269,469 | 5/1981 | Audic | 339/177 R |
| 4,598,961 | 7/1986 | Cohen | 339/276 R |

*Primary Examiner*—Gil Weidenfeld
*Assistant Examiner*—David Pirlot
*Attorney, Agent, or Firm*—Rosen, Dainow & Jacobs

[57] ABSTRACT

An L-type coaxial plug connector adapted to be connected to one end of a coaxial cable has a crimp sleeve on the outer sheath of the coaxial cable and adapted to be collapsed so as to fix the coaxial cable to the plug connector. The outer shell has a cylindrical portion holding a dielectric member in which the central terminal is fixed, a cylindrical outer conductor fitting portion adapted to be inserted into the boundary between the inner dielectric layer and the outer conductor of the coaxial cable, and an intermediate portion which extends axially from a portion of the upper circumferential edge of the cylindrical portion so as to connect the portion of the cylindrical portion to the corresponding portion of the lower circumferential edge of the outer conductor fitting portion, such that the axes of said cylindrical portion and the outer conductor fitting portion extend in parallel with each other. The intermediate portion has a U-shaped arm portion which extends from the intermediate portion in the direction perpendicular to the axis of the cylindrical portion, and a cover portion which is adapted to cover the adjacent open end of the cylindrical portion when the intermediate portion is flexed substantially orthogonally towards the U-shaped arm portion.

5 Claims, 6 Drawing Figures

L-TYPE COAXIAL PLUG CONNECTOR

BACKGROUND OF THE INVENTION

1. Field of the Invention

The present invention relates to an improvement in the construction of an L-type coaxial plug connector and, more particularly, to an inexpensive and compact L-type plug connector having a distinguished reliability.

2. Description of the Prior Art:

Japanese Utility Model Publication No. 41342/1981 discloses a typical L-type coaxial plug connector. This known L-type coaxial plug connector has encountered the following problems.

This plug connector has an L-type crimp sleeve which exhibits a large opening at the radially outer side of the curvature. It is true that this opening can be closed by a sheath after the completion of connection of the coaxial cable to the connector. However, when the plug connector is inserted into or withdrawn from a mating connector, the manual force exertd by the operator tends to be applied to the opening in the L-type sleeve, so as to cause a displacement and/or deformation of the dielectric layer in the sheathed cable, thus adversely affecting the connection between the core conductor and the female terminal. In the worst case, the electrical connection may fail in the coaxial cable. The displacement and/or deformation of the dielectric layer in the cable causes problems such as generation of electrical noises and disturbance of V.S.W.R.

In addition, since the connecting side of the L-type crimp sleeve has a complicated construction constituted by a number of parts, e.g., outer sleeve, outer conductor, coiled spring and so forth, the reliability of electrical connection is impaired due to a large number of connections to be achieved and the price of the product tends to be increased as a result of an increase in the number of steps of the assembly process.

It is to be pointed out also that, since the outer conductor fitting portion of this connector does not have double-layer holding construction employing a crimp sleeve, the cable after connection to the terminal tends to be displaced outwardly due to the resilience of the cable itself and the spring back of the outer conductor fitting portion, even though this portion has a serration for preventing the cable from coming off.

SUMMARY OF THE INVENTION

Accordingly, an object of the invention is to provide an L-type coaxial plug connector having a miniaturized and compact construction and incorporating an outer shell which is capable of completely surrounding the coaxial cable so as to attain a high rigidity of the connection between the plug and the coaxial cable.

To this end, according to the invention, there is provided an L-type coaxial plug connector which comprises: a central terminal adapted to be connected to the core conductor of a coaxial cable so as to constitute a part of the core conductor of the coaxial line to be formed; an outer shell adapted to be connected to the outer conductor of the coaxial cable so as to constitute a part of the outer conductor of the coaxial line to be formed; and a crimp sleeve on the outer sheath of the coaxial cable and adapted to be collapsed so as to fix the coaxial cable to the plug connector.

The outer shell has a cylindrical portion holding a dielectric member in which the central terminal is fixed, a cylindrical outer conductor fitting portion adapted to be inserted into the boundary between the inner dielectric layer and the outer conductor of the coaxial cable, and an intermediate portion which extends axially from a portion of the upper circumferential edge of the cylindrical portion so as to connect the portion of the cylindrical portion to the corresponding portion of the lower circumferential edge of the outer conductor fitting portion such that the axes of the cylindrical portion and the outer conductor fitting portion extend in parallel with each other.

The intermediate portion has a U-shaped arm portion which extends from the intermediate portion in the direction perpendicular to the axis of the cylindrical portion, and a cover portion which is adapted to cover the adjacent open end of the cylindrical portion when the intermediate portion is flexed substantially orthogonally towards the U-shaped arm portion.

The connection between this L-type coaxial plug connector and a coaxial cable is accomplished in a manner which will be explained hereinunder.

As the first step, the end of the coaxial cable to be connected is stripped such that the core conductor, inner dielectric layer, outer conductor and the outer sheath are exposed in the mentioned order. The cable is then inserted into the sleeve. Then, the cable is moved ahead such that the inner dielectric layer is received in the outer conductor fitting portion. Then, the cable is further advanced so that the core conductor of the coaxial cable is inserted into the central terminal fixed to the outer shell, while the outer conductor fitting portion of the outer shell cuts into the boundary between the outer conductor and the inner dielectric layer of the coaxial cable, until the end of the core conductor slightly projects from the end of the central terminal as shown in FIG. 3.

Subsequently, the intermediate portion of the outer shell is bent substantially orthogonally towards the U-shaped arm portion. In consequence, the outer U-shaped arm portion and the cover portion of the outer shell in cooperation form a bent tube which completely surrounds the coaxial cable. Then, the crimp sleeve is moved to a position where it surrounds the outer conductor fitting portion and is collapsed by a suitable means. Finally, the end of the central terminal is rigidly fixed to the core conductor of the cable by, for example, press-bonding method, and the portion of the core conductor projecting beyond the end of the central terminalis cut as shown in FIG. 4, thus completing the connection between the coaxial cable and the plug connector.

The U-shaped arm may have arms which extend to the position where the outer conductor fitting portion is located after the flexing of the outer shell. In such a case, the arms can be placed between the outer sheath of the coaxial cable and the crimp sleeve when the latter has been brought to the position where it surrounds the outer conductor fitting portion, thus providing a stiffening effect to the connection.

The outer conductor fitting portion of the outer shell may be provided with annular grooves and ridges in the outer and/or the inner peripheral surface thereof, so that the outer conductor fitting portion can more firmly grip the associated members, thus attaining a higher reliability of the connection.

The above and other objects, features and advantages of the invention will become clear from the following description of the preferred embodiment when the same is read in conjunction with the accompanying drawings.

DESCRIPTION OF THE PREFERRED EMBODIMENT

Figure 1:
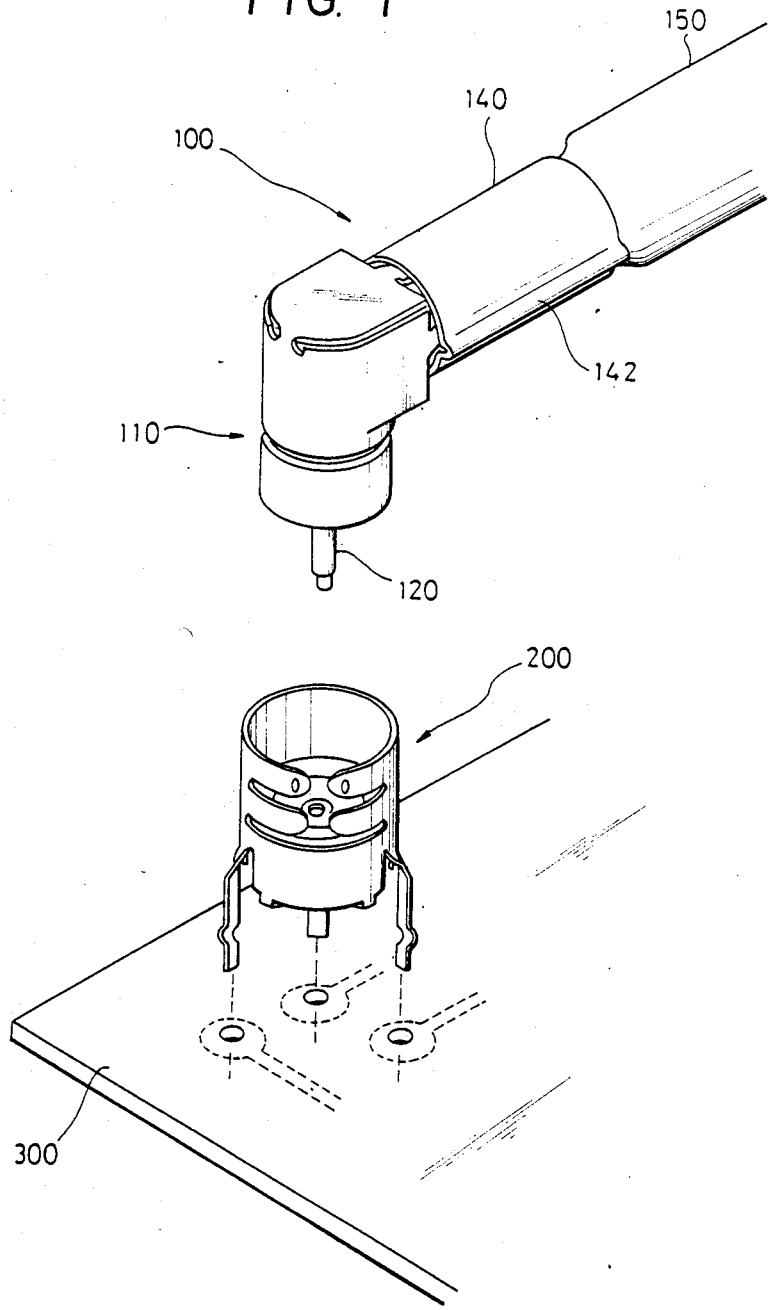
FIG. 1 is a perspective view of an L-type coaxial plug connector embodying the present invention, illustrated in relation to a mating connector on a printed circuit board.

A preferred embodiment of the invention will be described hereinunder with reference to FIGS. 1 to 4.

Referring to these Figures, an L-type coaxial connector, designated generally at a reference numeral 100, is adapted to mate to a receptacle connector 200 which is of the type adapted to be attached to a printed circuit board 300.

The plug connector 100 has an outer shell 110, a male terminal 120 as the central terminal and a crimp sleeve 140.

Figure 2A:
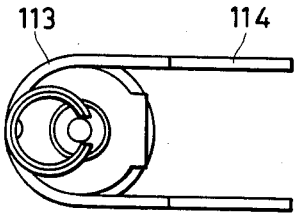
FIG. 2A is a plan view of an outer shell of the L-type plug connector shown in FIG. 1, in the state before the connection to a coaxial cable.
Figure 2B:
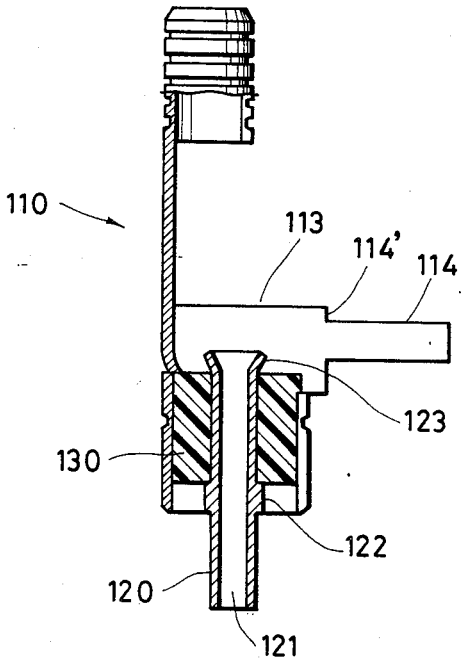
FIG. 2B is a partly-sectioned side elevational view of the outer shell.
Figure 2C:
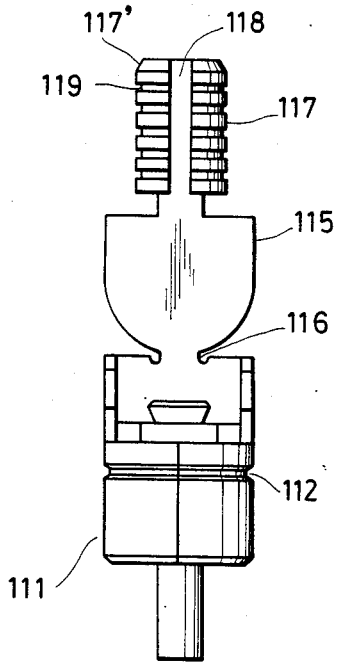
FIG. 2C is a right-side elevational view of the outer shell.

FIGS. 2A, 2B and 2C are a plan view, a front elevational view and a right-side elevational view of the plug connector in the state before the connection. As will be seen from these Figures, the outer shell 110 is formed by press from a suitable metal sheet and holds therein a dielectric member 130 which in turn fixedly supports a male terminal 120. The outer shell 110 also has an outer cylindrical portion 111 for connection to the outer conductor shell of the mating connector. A locking groove 112 is formed in an upper part of the cylindrical portion which is adapted to be engaged by a corresponding portion of the mating connector, so as to lock both connectors to each other. A U-shaped arm portion 113 is provided immediately on the cylindrical portion 111, so as to extend at a right angle to the axis of the cylindrical portion 111. The arm portion 113 has two arms 114 each having a step 114'. As will be explained later, the arms 114 extend to the position at which the outer conductor fitting portion is located when the outer shell 110 is flexed at the neck portion of the outer shell 110. A cover portion 115 is provided on the upper side of the U-shaped arm portion 113. The cover portion 115 is adapted to cover the upper opening of the cylindrical portion 111 when the outer shell is flexed. A neck portion 116 which is shaped in such a manner as to facilitate the flexing of the shell 110 at 90° into L-like form is formed between the cover portion 115 and the U-shaped arm portion 113. The U-shaped arm portion 113 and the cover portion 115 provides an intermediate portion of the shell 110. An outer conductor fitting portion 117 having a slit 118 is formed on the upper side of the cover portion 115 integrally therewith. The outer peripheral surface of the outer conductor fitting portion 119 is provided with annular ridges and grooves as denoted by a numeral 119, so as to firmly engage with the outer conductor of the coaxial cable, thereby attaining a high strength of connection.

Figure 3:
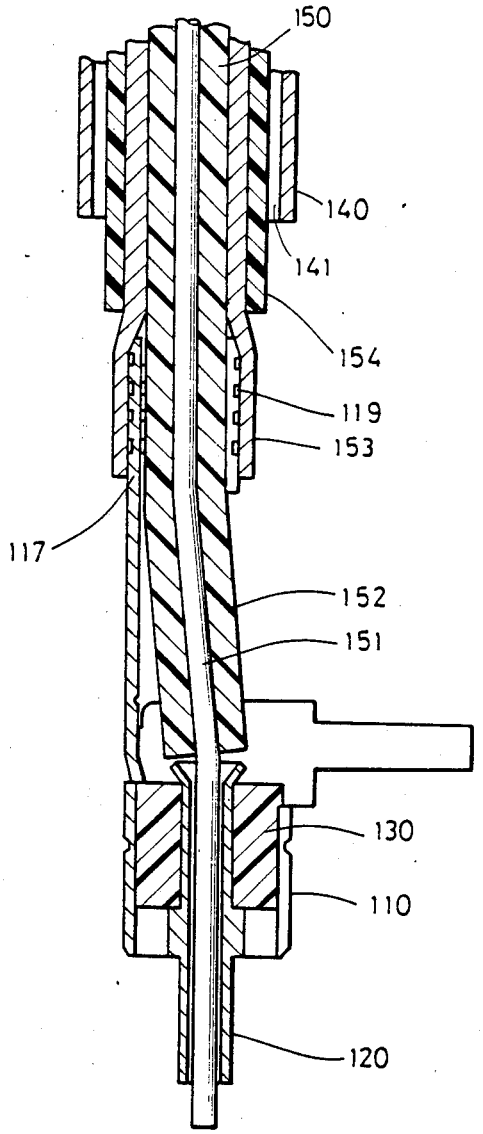
FIG. 3 is a vertical sectional view of the outer shell in the state in which it receives a coaxial cable.

The male terminal 120 is shaped from a metallic material into a cylindrical form as shown in FIGS. 2B and 3, and has a hollow 121. A collar 122 for preventing the dielectric member 130 from coming off is provided on an intermediate portion of the cylindrical male terminal 120. The upper end of the male terminal 120 is expanded and caulked as at 123 so that the male terminal 120 is fixed to the dielectric member 130.

On the other hand, the crimp sleeve 140 has an inside diameter greater than the outside diameter of the coaxial cable 150 so as to leave an annular gap 141 therebetween, as shown in FIG. 3.

The L-type coaxial plug connector of the invention, having the construction heretofore described, is connected to a coaxial cable in a manner which will be explained hereinunder.

As the first step, the coaxial cable 150 is suitably stripped by, for example, stripping at its end to be connected to the plug connector 100. Then, the core conductor 151 and the inner dielectric layer 152 of the cable are inserted into the hollow 121 of the male terminal 120. As a result, the outer conductor fitting portion 117 of the outer shell 110 is forcibly moved to cut into the boundary between the inner dielectric layer 152 and the outer conductor 153. This movement is facilitated by the tapered end surface 117' of the outer conductor fitting portion 117. When the core conductor has reached the end of the hollow 121 of the male terminal 120 as shown in FIG. 3, the end of the male terminal 120 is fixed to the core conductor 151 by caulking or by soldering, as shown in FIG. 3.

Figure 4:
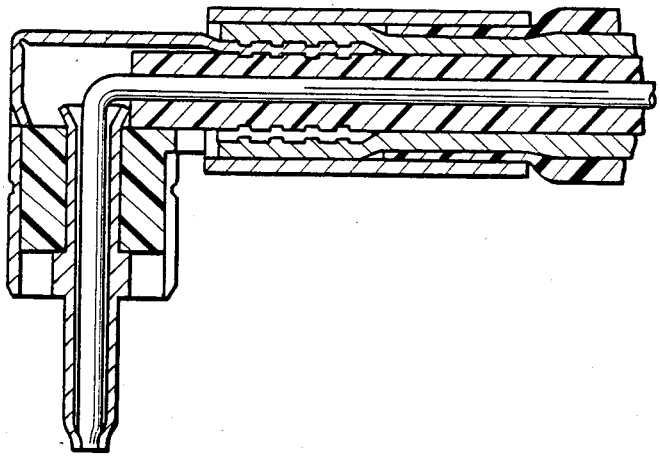
FIG. 4 is a vertical sectional view of the L-type coaxial plug connector in the final state in which the outer shell has been flexed and a crimp sleeve has been collapsed.

Subsequently, the outer shell 110 is flexed through 90° at the neck portion 116. This causes also the core conductor 151 and the inner dielectric layer 152 of the coaxial cable to be flexed through 90°. Then, the crimp sleeve 140 is moved until it contacts the step 114' of the arms 114 of the U-shaped arm portion 113, such that the arms 114 are received in the crimp sleeve 140. Then, by using a suitable crimp tool (not shown), the crimp sleeve 140 is collapsed and caulked as shown in FIG. 1, so that the plug connector is firmly connected to the coaxial cable, as shown in FIG. 4. Namely, as a result of a reduction in the diameter of the crimp sleeve 140, the outer conductor 153 of the coaxial cable is firmly clamped between the outer conductor fitting portion 117 and the inner surface 141 of the crimp sleeve 140, so that the plug connector and the coaxial cable are integrally connected both electrically and mechanically. Furthermore, since the outer conductor fitting portion 117 also is contracted radially, the inner surface of the receiving portion 117 also is pressed onto the inner dielectric layer 152, thus attaining a tight connection therebetween.

After the connection has been accomplished, a pair of longitudinal ridges 142 are left on both sides of the crimp sleeve 140, as will be seen from FIG. 1. These longitudinal ridges have been formed as a result of plastic deformation of the sleeve material caused by the crimp tool, and are effective in preventing any springback of the sleeve 140 due to its resiliency.

Although in the described embodiment the center terminal constitutes a male terminal, this is not exclusive and the center terminal may be constructed as a female terminal.

The plug connector in accordance with the present invention offers the following advantages.

The outer shell can be mass-produced at a low cost by a press from a sheet material. The L-type coaxial connector of the invention has a very simple construction constituted by only few constituent elements. This in turn permits a reduction in the number of steps of the assembly process, and affords a higher reliability of connection by crimping. Moreover, the size and the price of the connector are reduced advantageously.

The L-type coaxial plug connector of the invention does not have any opening in the flexed portion thereof so that no substantial external force is applied to the dielectric layer of the cable during the insertion and withdrawal of the L-type coaxial plug connector to and from the mating connector, whereby the aforementioned problems of the prior art caused by the external force are avoided.

In addition, since the conductor fitting portion is inserted into the cable outer conductor which in turn is contracted by the crimp sleeve caulked onto the outer sleeve, the cable and the outer shell are integrally connected rigidly, thereby attaining a high reliability of the mechanical and electrical connection.

What is claimed is:

1. An L-type coaxial plug connector comprising:

a central terminal adapted to be connected to the core conductor of a coaxial cable so as to constitute a part of the core conductor of the coaxial line to be formed;

an outer shell adapted to be connected to the outer conductor of said coaxial cable so as to constitute a part of the outer conductor of the coaxial line to be formed;

and a crimp sleeve on an outer sheath of said coaxial cable and adapted to be collapsed so as to fix said coaxial cable to said plug connector;

wherein said outer shell has a cylindrical portion holding a dielectric member in which said central terminal is fixed, a cylindrical outer conductor fitting portion adapted to be inserted into the boundary between the inner dielectric layer and the outer conductor of said coaxial cable, and an intermediate portion which extends axially from a portion of an upper circumferential edge of said cylindrical portion so as to connect said portion of said cylindrical portion to the corresponding portion of the lower circumferential edge of said outer conductor fitting portion such that the axes of said cylindrical portion and said outer conductor fitting portion extend in parallel with each other, said intermediate portion having a U-shaped arm portion which extends from said intermediate portion in the direction perpendicular to said axis of said cylindrical portion, and a cover portion which is adapted to cover an adjacent open end of said cylindrical portion when said intermediate portion is flexed substantially orthogonally towards said U-shaped arm portion.

2. An L-type coaxial plug connector according to claim 1, wherein said U-shaped arm portion has arms which extend to a position where said outer conductor fitting portion is located when said intermediate portion of said outer shell is flexed, said arms being adapted to be received in the gap between said outer conductor of said coaxial cable and said crimp sleeve so as to be pressed onto said outer conductor of said coaxial cable when said crimp sleeve is collapsed, thus serving as an auxiliary connector for connecting said outer conductor.

3. An L-type coaxial plug connector according to claim 1, wherein said outer conductor fitting portion is provided in the outer peripheral surface thereof with annular grooves and ridges.

4. An L-type coaxial plug connector according to claim 1, wherein said outer conductor fitting portion is provided in the inner peripheral surface thereof with annular grooves and ridges.

5. An L-type coaxial plug connector according to claim 3 wherein said outer conductor fitting portion is provided in the inner peripheral surface thereof with annular grooves and ridges.

* * * * *

UNITED STATES PATENT AND TRADEMARK OFFICE

CERTIFICATE OF CORRECTION

PATENT NO. : 4,678,261

DATED : July 7, 1987

INVENTOR(S) : Ikujirou Mitani, et al

It is certified that error appears in the above-identified patent and that said Letters Patent is hereby corrected as shown below:

IN THE ABSTRACT:

Line 2 of ABSTRACT after "coaxial cable has a" omit --crimp sleeve ... plug connector-- and insert --central terminal adapted to be connected to the core conductor of the coaxial cable so as to constitute a part of the core conductor of the coaxial line to be formed, an outer shell adapted to be connected to the outer conductor of the coaxial cable so as to constitute a part of the outer conductor of the coaxial line to be formed, and a crimp sleeve on the outer sheath of the

UNITED STATES PATENT AND TRADEMARK OFFICE

CERTIFICATE OF CORRECTION

PATENT NO. : 4,678,261

DATED : July 7, 1987

INVENTOR(S) : Ikujirou Mitani, et al

It is certified that error appears in the above-identified patent and that said Letters Patent is hereby corrected as shown below:

coaxial cable and adapted to be collapsed so as to fix the coaxial cable to the plug connector --.

Signed and Sealed this

First Day of March, 1988

*Attest:*

*Attesting Officer*

DONALD J. QUIGG

*Commissioner of Patents and Trademarks*